US008470452B2

(12) United States Patent
Chaney et al.

(10) Patent No.: US 8,470,452 B2
(45) Date of Patent: Jun. 25, 2013

(54) WEAR RESISTANT CERAMIC COATED ALUMINUM ALLOY ARTICLE

(75) Inventors: Mark R. Chaney, Bonita Springs, FL (US); Frederick A. Campbell, Webster, NY (US)

(73) Assignee: Calvary Design Team, Inc., West Henrietta, NY (US)

( * ) Notice: Subject to any disclaimer, the term of this patent is extended or adjusted under 35 U.S.C. 154(b) by 0 days.

(21) Appl. No.: 13/165,130

(22) Filed: Jun. 21, 2011

(65) Prior Publication Data

US 2011/0247939 A1 Oct. 13, 2011

Related U.S. Application Data

(62) Division of application No. 11/724,979, filed on Mar. 16, 2007, now abandoned.

(51) Int. Cl.

| | |
|---|---|
| ***B32B 15/04*** | (2006.01) |
| ***C25D 11/06*** | (2006.01) |
| ***C25B 7/00*** | (2006.01) |

(52) U.S. Cl.

USPC ..... 428/640; 205/323; 205/50; 205/326; 428/688; 428/702; 428/701

(58) Field of Classification Search

None

See application file for complete search history.

(56) References Cited

U.S. PATENT DOCUMENTS

| | | | | |
|---|---|---|---|---|
| 3,573,117 | A * | 3/1971 | Cocks | 148/701 |
| 4,371,589 | A * | 2/1983 | Warner et al. | 428/553 |
| 5,520,768 | A * | 5/1996 | Crook et al. | 156/319 |
| 5,545,268 | A * | 8/1996 | Yashiki et al. | 148/518 |
| 5,720,866 | A | 2/1998 | Erokine et al. | |
| 5,976,997 | A | 11/1999 | Meaney et al. | |
| 6,176,982 | B1 | 1/2001 | Rickerby | |
| 6,197,178 | B1 * | 3/2001 | Patel et al. | 205/81 |
| 6,365,028 | B1 | 4/2002 | Shatrov | |
| 6,893,551 | B2 * | 5/2005 | Krishna et al. | 205/316 |
| 6,896,785 | B2 | 5/2005 | Shatrov | |
| 6,981,439 | B2 | 1/2006 | Hart | |
| 2003/0094377 | A1 * | 5/2003 | Krishna et al. | 205/316 |
| 2005/0132877 | A1 * | 6/2005 | Hart | 91/509 |
| 2007/0241530 | A1 * | 10/2007 | Nonoshita et al. | 280/259 |

OTHER PUBLICATIONS

MatWeb-material property data at matweb.com, entry for aluminum alloy 7075, Jun. 18, 2010.

Dowloaded Jan. 7, 2013 from: Wikipedia, the free encycopedia; http://en.wikipedia.org/wiki/anodizing.

* cited by examiner

*Primary Examiner* — Vera Katz

(74) *Attorney, Agent, or Firm* — Michael L. Dunn

(57) ABSTRACT

A wear resistant ceramic coated aluminum alloy article. The article is made by a method including the steps of: a) immersing the article in an aqueous electrolyte containing from about 1.5 to about 2.5 grams per liter of alkali metal hydroxide and from about 6.5 to about 9.5 grams per liter of alkali metal silicate. No more than 1 g per liter of alkali metal pyrophosphate is present and no more than about 0.05 percent of hydrogen peroxide is present, and b) applying an alternating current through the electrolyte using the article as one electrode where a second electrode includes at least one of an electrically conductive container or an immersed separate electrode, where applied EMF is selected to provide a current density of from about 15 to about 25 A/dm$^2$, for a sufficient time to obtain a wear resistant ceramic coating having a thickness of from about 125 to about 150 μm.

12 Claims, 7 Drawing Sheets

WEAR RESISTANT CERAMIC COATED ALUMINUM ALLOY ARTICLE

CROSS REFERENCE TO RELATED APPLICATIONS

This application is a division of U.S. patent application Ser. No. 11/724,979, filed Mar. 16, 2007. The subject matter of the above priority applications including drawings is incorporated by reference in its entirety.

BACKGROUND OF THE INVENTION

This invention relates to aluminum or aluminum alloy parts and their use in applications requiring wear resistance and more particularly relates to ceramic coated aluminum oxide articles having improved wear resistance and to their method of manufacture.

Because of weight reduction and corrosion resistance, the use of aluminum and its alloys in numerous applications is desirable. Unfortunately aluminum and its alloys are not suitable in such applications where high wear resistance is needed.

Aluminum products have been known that have oxidized surfaces that increase corrosion resistance, and to some extent wear resistance, through a process known as anodization. In such a process aluminum or its alloys are immersed in an acidic electrolyte and subjected to a DC current as an anode to form a corrosion inhibiting aluminum oxide layer. Such anodized layers may also somewhat increase wear resistance, especially in the case of "hardcoat" anodizing that can provide oxide thicknesses of as much as about 0.01 inch (250 μm). The increased wear resistance is believed to be at least partly due to the increased thickness but the wear resistance is still not nearly as good as needed or desired in machine parts.

More recently, e.g. as described in U.S. Pat. Nos. 5,720,866 and 6,365,028, incorporated herein by reference as background art, a process has been described that uses alternating current, instead of a direct current and an alkaline electrolyte, instead of an acidic electrolyte to obtain a coating on aluminum and its alloys. The described process is complex generally requiring an at least three component electrolyte containing a relatively large amount of a pyrophosphate and requiring a high starting current density.

Using the process described in this patent, articles can be obtained that have greatly improved wear resistance as compared with anodized products. Such products have been made by Keronite International, Ltd. of the United Kingdom. Wear resistance increases of as much as twenty times that of aluminum or aluminum alloy alone have been reported.

In any case a wear resistance increase of twenty times over untreated aluminum alloy is significant but still not as good as desired.

BRIEF DESCRIPTION OF THE INVENTION

Figure 1:
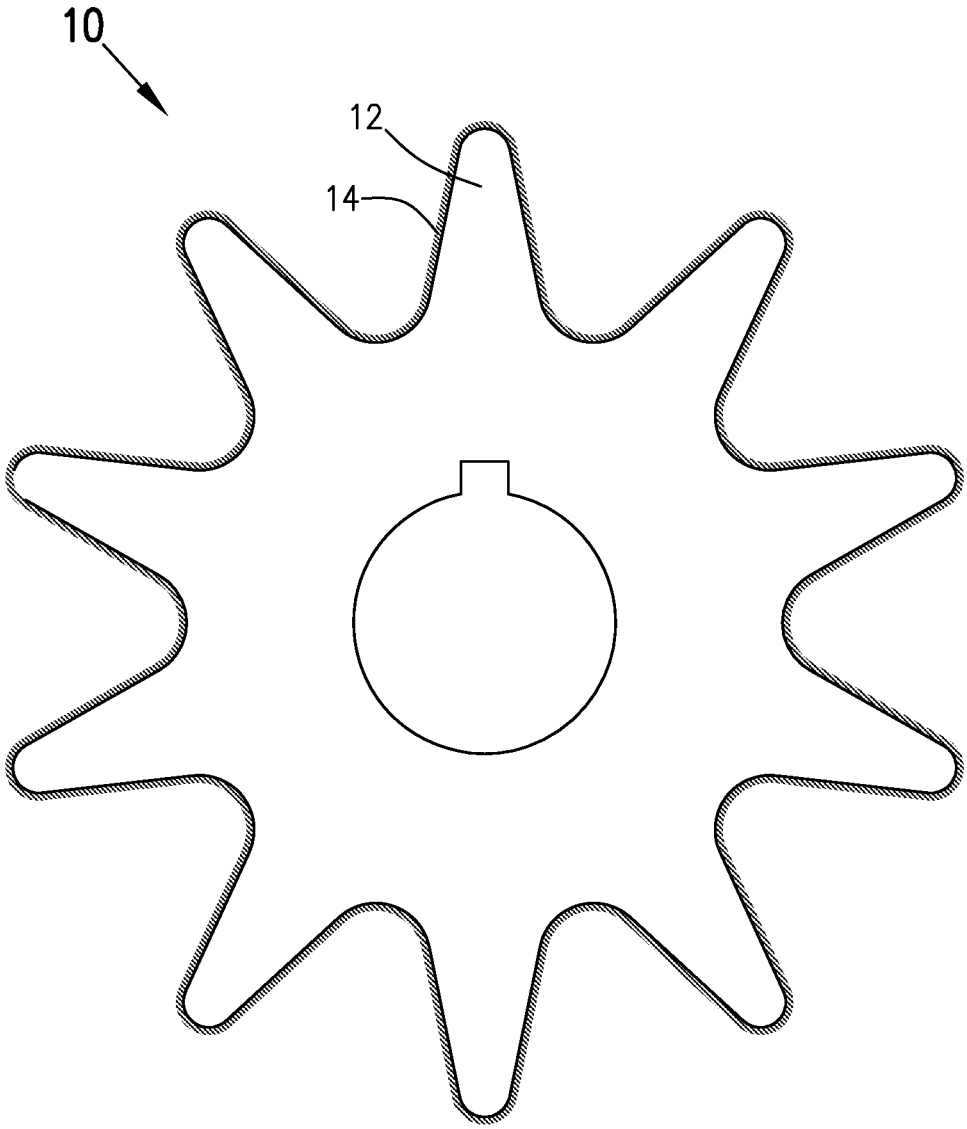
FIG. 1 is a side view of a sprocket coated in accordance with the invention

The invention includes a ceramic coated aluminum or aluminum alloy article having wear resistance of at least thirty times that of a comparable uncoated aluminum or aluminum alloy article under the same wear conditions. The invention further includes a method for making such articles.

More particularly, the invention includes a method for forming a wear resistant ceramic coating on an aluminum alloy article. The alloy preferably contains from about 85 to about 92 percent aluminum with a plurality of other oxidizable metals selected from copper, magnesium, zinc, and chromium. Less that about 2 percent total of other elements is usually present. In accordance with the invention, the alloy preferably contains less than 0.5 percent each of manganese, iron and silicon. An example of such an alloy is 7075 aluminum alloy.

The method includes the steps of:

a) immersing the article in an aqueous electrolyte containing from about 1.5 to about 2.5 grams per liter of alkali metal hydroxide and from about 6.5 to about 9.5 grams per liter of alkali metal silicate. In general no more than 1 g per liter of alkali metal pyrophosphate is present and no more than about 0.05 percent of hydrogen peroxide is present, and b) applying an alternating current through the electrolyte using the article as one electrode where a second electrode includes at least one of an electrically conductive container or an immersed separate electrode, where applied EMF is selected to provide a current density of from about 15 to about 25 $A/dm^2$, for a sufficient time to obtain a wear resistant ceramic coating having a thickness of from about 125 to about 150 μm, as measured on a flat face of the article.

It is to be understood that parts and percentages are by weight.

DETAILED DESCRIPTION OF THE INVENTION

In accordance with the invention, it has been surprisingly discovered that a ceramic coated aluminum or aluminum alloy article, having superior wear resistance in excess of thirty and as much as forty times the wear resistance of raw aluminum or raw aluminum alloy, can be obtained by simplifying the above described prior method where a wear resistance of only up to about twenty times raw aluminum or aluminum alloy can be obtained.

In particular, in accordance with the present invention, and contrary to teachings of the above discussed prior art, the electrolyte used in the present invention contains less than 0.05 percent hydrogen peroxide and preferably no hydrogen peroxide and contains less one gram per liter of pyrophosphate and preferably no pyrophosphate. In general, other additives and modifiers, described in the above prior art as being needed or desired, are not present in the electrolyte used in accordance with the invention. The electrolyte preferably contains no components (other than water) that form gases upon electrolysis. The electrolyte preferably is an aqueous solution of from about 1.5 to about 2.5 grams per liter of potassium hydroxide and from about 6.5 to about 9.5 grams per liter of sodium silicate Further, in accordance with the present invention, initial high current densities are not used, contrary to the teachings of the above prior art where high initial current densities are described as being needed or desired. The current used in the method is an alternating current preferably having a frequency of from about 30 to about 2000 cycles per second (cps) and most commonly from about 50 to about 60 cps.

Ceramic coating, as used herein, means a crystalline or microcrystalline high temperature resistant chemical compound that at a minimum contains aluminum and oxygen. Although the ceramic structure is complex, it may be conveniently represented as containing a major portion of an aluminum oxide or modified aluminum oxide. Again, even though the ceramic material is complex including physically and chemically intertwined oxides, it may conveniently be represented as also containing lesser amounts of oxides of copper, magnesium, zinc, chromium, manganese, iron and silicon.

The time for employing the method of the invention can vary but must be neither too fast, which tends to create porous and or weak coatings or too slow which lends inefficiency to the process. In general, the desired time is from about 100 to about 160 minutes with about 120 minutes being preferred. In general, current density should not be above 25 Amperes per square decimeter (25 A/dm$^2$).

Articles needing excellent wear resistance, desirably made by the method of the invention, for example, include a wear resistant sprocket, gear, cylinder face, cylinder wall, bearing face, clutch face, disc brake face, brake pad face, or brake drum face. The method of the invention is especially suitable for the preparation of wear resistant timing sprockets including variable cam timing sprockets and proportional cam timing sprockets.

FIG. 1 shows a side view of an article of the invention in the form of a sprocket 10, having teeth 12 and having a ceramic coating 14, thereon, in accordance with the invention.

The following example illustrates the method of the invention and an article made thereby.

Essentially identical sprockets having an area of 2.56 dm$^2$ were machined from 7075 aluminum alloy. One of the sprockets was subjected to the method of the invention to provide a ceramic coating on its surface.

More particularly, the sprocket was immersed in an electrolyte bath having a composition of 2 grams per liter of potassium hydroxide and 8 grams per liter of sodium silicate. No significant amounts of other components were present. The sprocket was surrounded by a stainless steel cage where the cage acted as one electrode and the sprocket acted as another electrode. Upon startup, sufficient EMF was provided to obtain a current flow of from about 51 Amperes (A) and 52 A. Based upon the surface area of 2.56 dm$^2$, that amounted to an initial current density of about 20 A/dm$^2$ relative to the sprocket. This current density dropped over a time period of about 60 minutes to about 15.6 A/dm$^2$ at a total current flow of about 40 A resulting in a dense ceramic coating on the sprocket face having a thickness of about 70 μm to about 80 μm. The current flow of 40 A was then essentially maintained for 30 minutes, dropping to about 39 A at the end of the thirty minutes to obtain a dense ceramic coating having a total thickness of about 95 to about 110 μm. The current density was then maintained for an additional thirty minutes to obtain an end dense coating thickness of from about 125 to about 150 μm.

The sprocket was polished and tested for wear in a testing device having a sprocket mounting shaft within a container having a consistently maintained clean oil level. An electric drive was provided and a drive chain connected the motor with the sprocket to drive the sprocket. The sprocket was then driven for about 1200 hours at incrementally increasing speeds of 500, 800, 1200, 1600, 2000, 2400 and 2800 rpm with about 75 percent of the time at 2800 rpm. An equivalent "miles driven" calculation was made using the formula: D=(60R/2000)T where D=distance, R=rpm, and T=time. Based upon the above formula, the total miles driven was in excess of 85,000 miles with essentially no wear. A raw 7075 sprocket, as described above was subjected to essentially the same test. Initial signs of wear (polishing) occurred at only about 21 hours running initially for 50 minutes at 500 rpm and the balance minutes time at 800 rpm. Visible wear occurred on tooth sides at only about 48 hours. Wear became ever more apparent as the test proceeded.

No wear on the coated sprocket was apparent at the end of the test 1200 hours; whereas, initial signs of wear (polishing) occurred at only 21 hours and visible signs of tooth wear at tooth sides occurred at only about 44 hours. The coated sprocket therefore had a wear ratio to the raw aluminum alloy sprocket at initial signs of wear of the aluminum alloy of greater than 55 (1200/21) and the coated sprocket had a wear ratio to the raw aluminum alloy sprocket at clearly visible signs of wear of the aluminum alloy of greater than 27 (1200/44). This ratio is actually larger than 27 since the uncoated sprocket was not stopped and observed between 21 and 44 hours.

Figure 2:
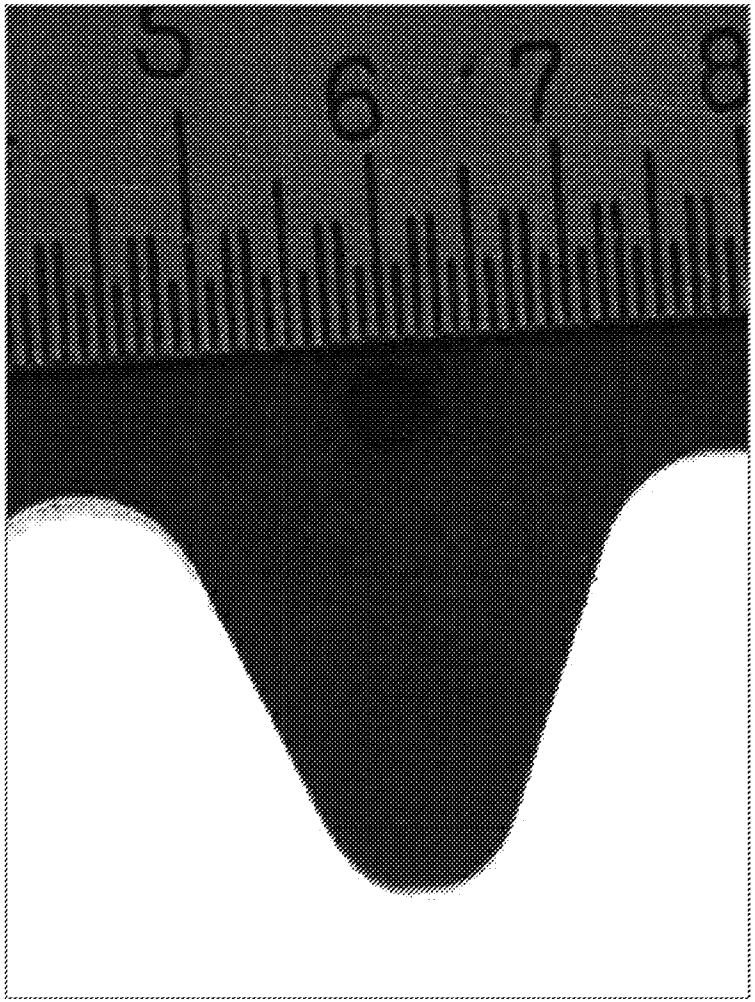
FIG. 2 is a magnified side view of a coated sprocket tooth prior to the test.
Figure 3:
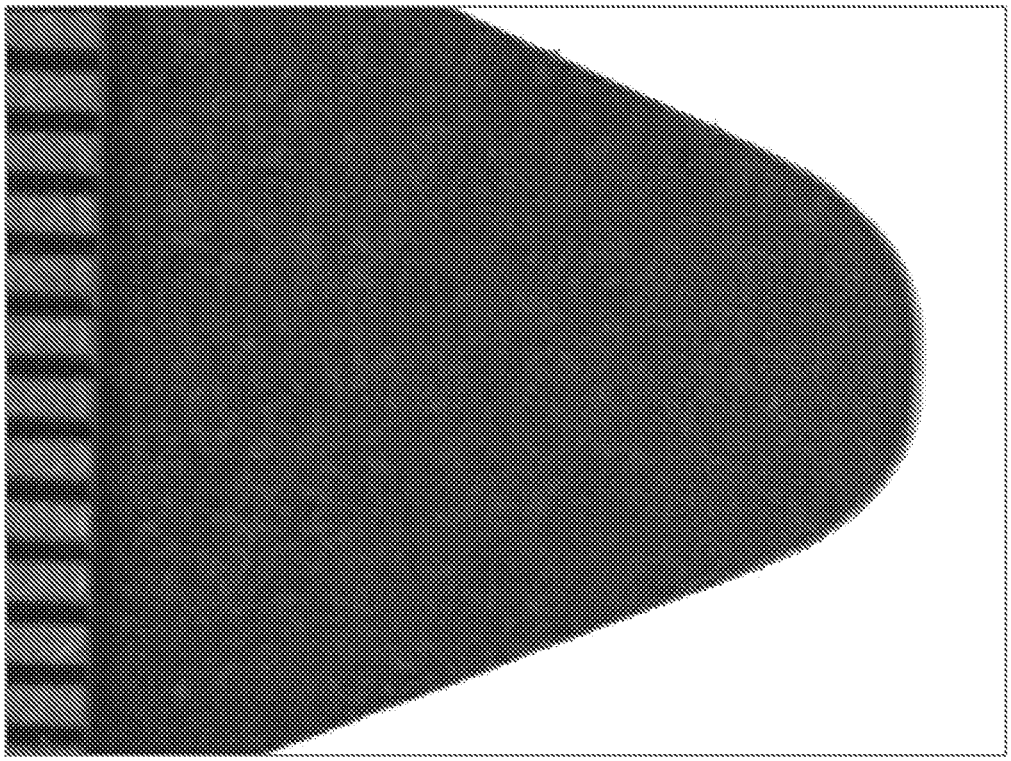
FIG. 3 is a magnified side view of a coated sprocket tooth after the test.
Figure 4:
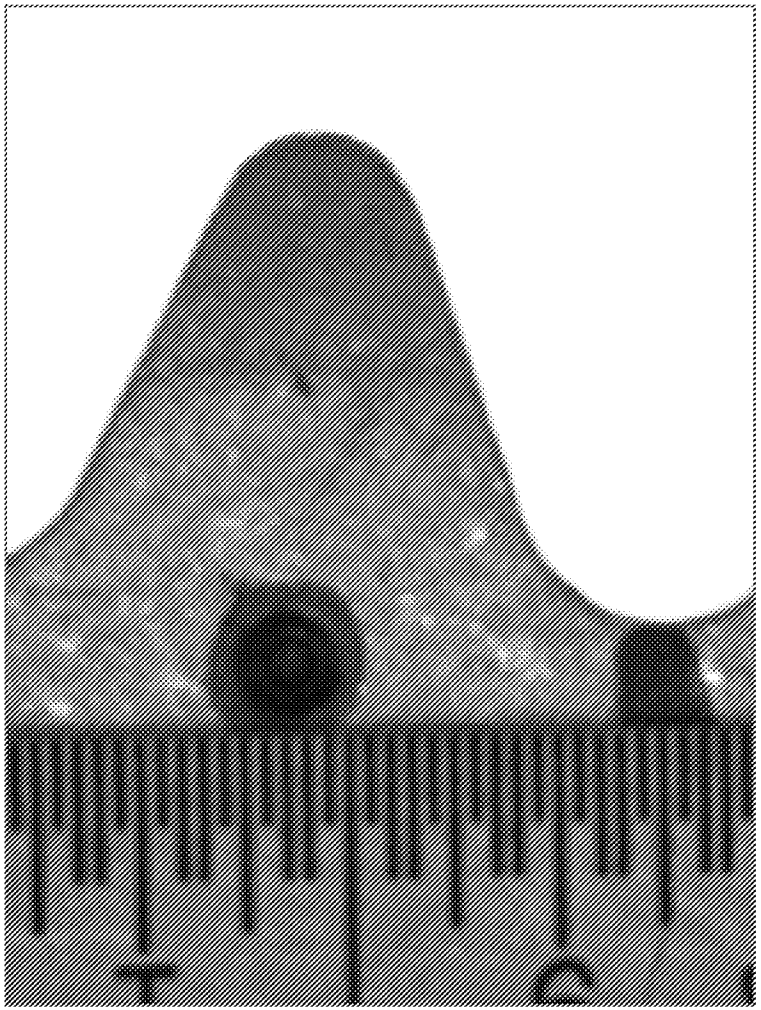
FIG. 4 is a magnified side view of a sprocket tooth of an uncoated sprocket before the test.
Figure 5:
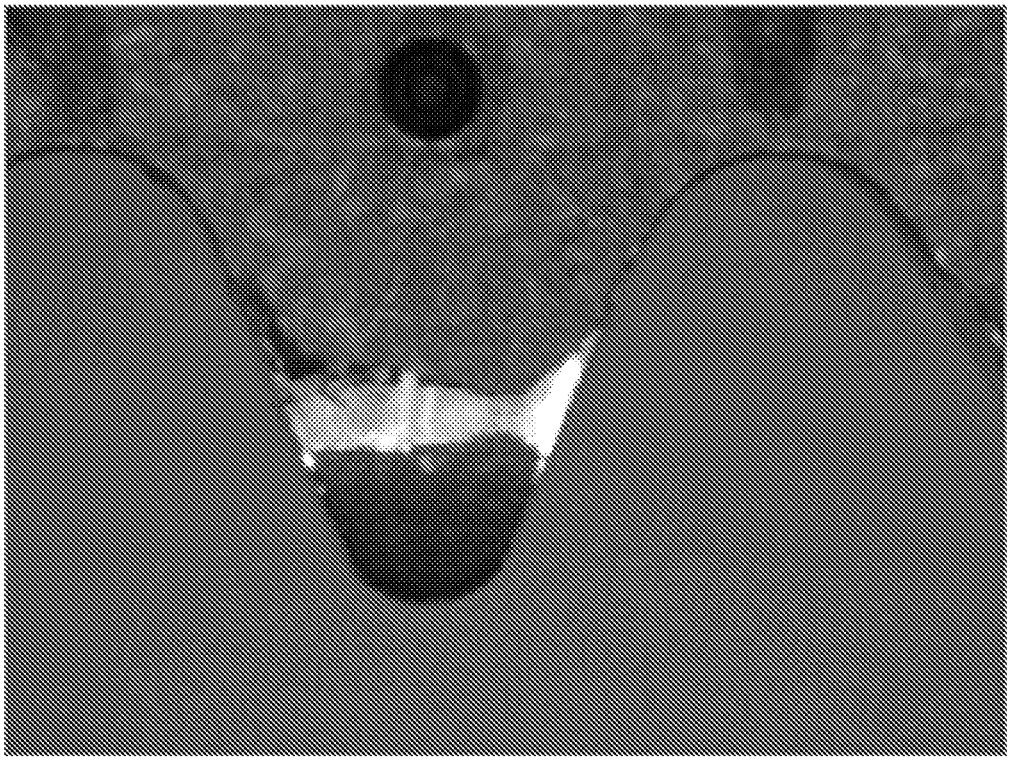
FIG. 5 is a magnified side view of an uncoated sprocket tooth after the test.

Photographs of sprocket teeth from a side view are shown in FIGS. 2-5 where FIG. 2 is a magnified side view of a coated sprocket tooth prior to the test, FIG. 3 is a magnified side view of a coated sprocket tooth after the test, FIG. 4 is a magnified side view of a sprocket tooth of an uncoated sprocket before the test, and FIG. 5 is a magnified side view of an uncoated sprocket tooth after the test. No wear is apparent on the coated sprocket after about 1200 hours. Serious wear is clearly visible on the uncoated sprocket tooth.

Figure 6:
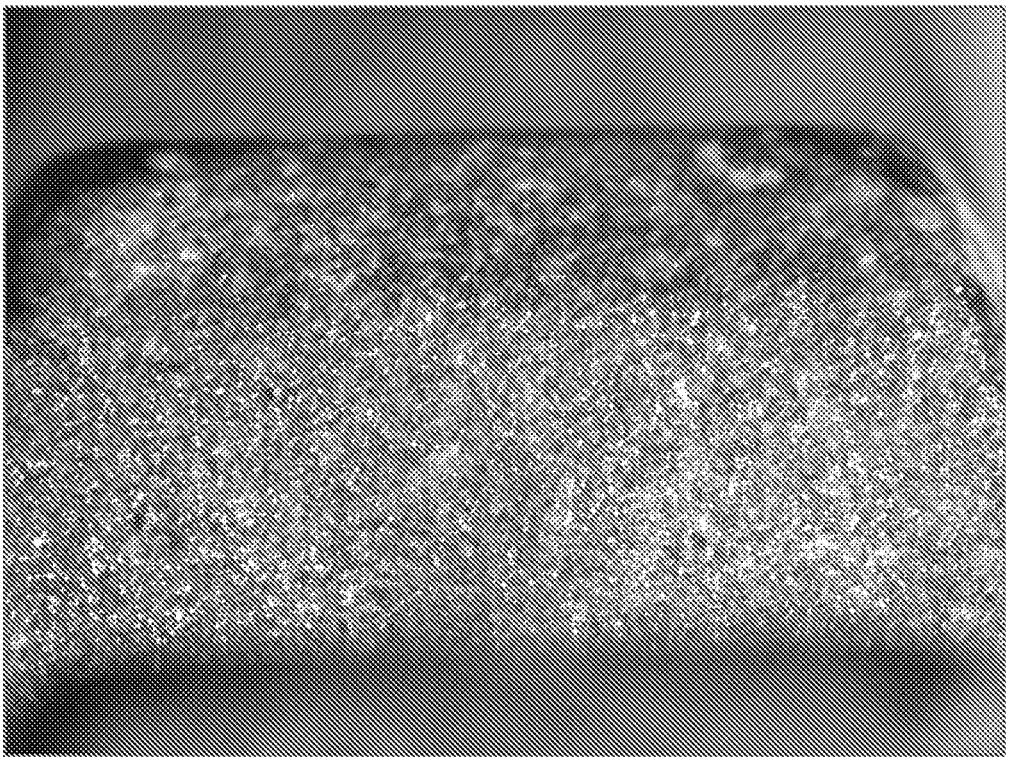
FIG. 6 shows a magnified tooth surface of a coated sprocket tooth after the test.

FIG. 6 shows a magnified tooth surface of a sprocket coated in accordance with the invention after the test. No significant wear is apparent.

Figure 7:
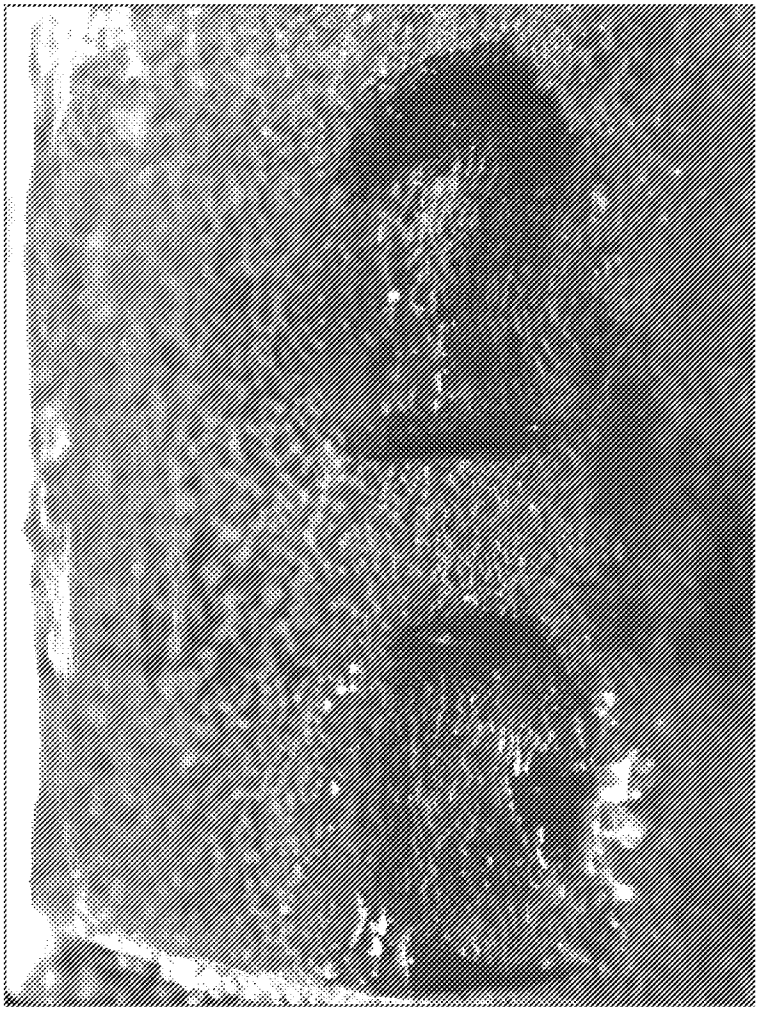
FIG. 7 shows a magnified tooth surface of an uncoated sprocket tooth after the test.

FIG. 7 shows a magnified tooth surface of an uncoated sprocket after the test. Serious wear is shown including pitting.

What is claimed is:

1. A wear resistant oxide coated aluminum alloy article in the form of a sprocket or gear, wherein the aluminum alloy substrate comprises 85 to 92 percent aluminum metal, 6 to 15 percent of metals selected from the group consisting of copper, magnesium, zinc and copper and less than 0.5 percent each of manganese, iron and silicon metals and the oxide coating comprises intertwined oxides of the alloy metals, said oxide coating being formed by:

a) immersing the aluminum alloy article in an aqueous electrolyte comprising from about 1.5 to about 2.5 grams per liter of alkali metal hydroxide, from about 6.5 to about 9.5 grams per liter of alkali metal silicate, in the absence of significant amounts of other components and in the absence of more than 1 g per liter of alkali metal pyrophosphate and in the absence of more than 0.05 percent hydrogen peroxide;

b) applying an alternating current through the electrolyte using the article as one electrode where a second electrode comprises at least one of an electrically conductive container or an immersed separate electrode, where applied EMF is selected to provide a current density of from about 15 to about 25 A/dm$^2$, for a sufficient time to obtain a wear resistant ceramic coating having a thickness of from about 125 to about 150 μm, as measured on a flat face of the article; and c) stopping the applying of the alternating current when the article has a wear resistant ceramic coating having a thickness of from about 125 to about 150 μm, as measured on a flat face of the article.

2. The wear resistant oxide coated aluminum alloy article of claim 1 where the electrolyte consists essentially of an aqueous solution of from about 1.5 to about 2.5 grams per liter of potassium hydroxide and from about 6.5 to about 9.5 grams per liter of sodium silicate.

3. The wear resistant oxide coated aluminum alloy article of claim 2 where the alternating current is from about 30 to about 2000 cps.

4. The wear resistant oxide coated aluminum alloy article of claim 2 where the alternating current is about 50 to about 60 cps.

5. The wear resistant oxide coated aluminum alloy article of claim 1 which is a cam timing sprocket.

6. An wear resistant oxide coated aluminum alloy article of claim 1 having a wear resistance greater than 30 times the wear resistance of the same uncoated aluminum alloy article under the same conditions.

7. The wear resistant oxide coated aluminum alloy article of claim 6 having a wear resistance greater than 40 times the wear resistance of the same uncoated aluminum alloy article under the same conditions.

8. The wear resistant oxide coated aluminum alloy article of claim 7 where the article is a sprocket.

9. The wear resistant oxide coated aluminum alloy article of claim 6 where the article is a sprocket.

10. The article of claim 9 where the sprocket is a variable cam timing sprocket or a proportional cam timing sprocket.

11. The wear resistant oxide coated aluminum alloy article of claim 1 where the time to obtain the thickness of from about 125 to about 150 μm is from about 100 to about 160 minutes.

12. The wear resistant oxide coated aluminum alloy article of claim 1 where the electrolyte is free of hydrogen peroxide.

* * * * *